US012618553B2

(12) United States Patent
Yan et al.

(10) Patent No.: US 12,618,553 B2
(45) Date of Patent: May 5, 2026

(54) BURNER, BURNER MODULE, BURNER ASSEMBLY AND HEATING DEVICE COMPRISING SAME

(71) Applicant: L'Air Liquide, Société Anonyme pour l'Etude et l'Exploitation des Procédés Georges Claude, Paris (FR)

(72) Inventors: Tao Yan, Shanghai (CN); Remi Tsiava, Saint Germain-les-Corbeil (FR); Peter van Kampen, Shanghai (CN); Yuquan Gu, Shanghai (CN)

(73) Assignee: L'Air Liquide, Societe Anonyme Pour l'Etude et l'Exploitation des Procedes Georges Claude, Paris (FR)

( * ) Notice: Subject to any disclaimer, the term of this patent is extended or adjusted under 35 U.S.C. 154(b) by 491 days.

(21) Appl. No.: 18/086,897

(22) Filed: Dec. 22, 2022

(65) Prior Publication Data

US 2023/0213184 A1 Jul. 6, 2023

(30) Foreign Application Priority Data

Dec. 30, 2021 (CN) ..... 202111680255.3

(51) Int. Cl.
*F23D 14/02* (2006.01)
*F23D 14/62* (2006.01)

(52) U.S. Cl.
CPC ..... *F23D 14/02* (2013.01); *F23D 14/62* (2013.01); *F23D 2200/00* (2013.01)

(58) Field of Classification Search
CPC ..... F23D 14/02; F23D 14/62; F23D 2200/00
USPC ..... 431/354
See application file for complete search history.

(56) References Cited

U.S. PATENT DOCUMENTS 2,982,348 A * 5/1961 Samothrakis ..... F23D 11/10 431/207
5,009,174 A * 4/1991 Polak ..... F23G 7/065 431/207
5,437,249 A * 8/1995 Adams ..... F24H 1/206 122/18.3
7,870,736 B2 1/2011 Homitz et al.
(Continued)

FOREIGN PATENT DOCUMENTS

CN 102788368 A 11/2012
CN 107575867 A 1/2018
(Continued)

OTHER PUBLICATIONS

European Search Report and Written Opinion for corresponding EP 22214329, Jun. 23, 2023.
(Continued)

*Primary Examiner* — Avinash A Savani
(74) *Attorney, Agent, or Firm* — Allen E. White

(57) ABSTRACT

A burner comprising least one first passage and at least one second passage are formed in the burner, the at least one first passage and the at least one second passage are arranged such that a first fluid from an outlet of the at least one first passage and a second fluid from an outlet of the at least one second passage are mixed with each other, and the at least one first passage is configured to cause the first fluid to produce a rotational flow in a first rotation direction, and/or, the at least one second passage is configured to cause the second fluid to produce a rotational flow in a second rotation direction.

10 Claims, 6 Drawing Sheets

(56) References Cited

U.S. PATENT DOCUMENTS

| | | | | |
|---|---|---|---|---|
| 10,794,589 | B2 | 10/2020 | Shershnyov et al. | |
| 2007/0137171 | A1* | 6/2007 | Chapin | F23R 7/00 60/749 |
| 2007/0194146 | A1 | 8/2007 | Dorendorf | |
| 2012/0291447 | A1 | 11/2012 | Boardman et al. | |
| 2015/0291465 | A1 | 10/2015 | Cowles et al. | |
| 2016/0060154 | A1 | 3/2016 | Cowles et al. | |
| 2016/0075587 | A1 | 3/2016 | Baker | |
| 2019/0078777 | A1* | 3/2019 | Keller | F23D 14/24 |
| 2019/0092670 | A1 | 3/2019 | Baker et al. | |

FOREIGN PATENT DOCUMENTS

| | | | |
|---|---|---|---|
| CN | 109163565 | A | 1/2019 |
| CN | 210426055 | U | 4/2020 |
| CN | 111578715 | A | 8/2020 |
| JP | 6013246 | B2 | 10/2016 |
| WO | 2014 201106 | A1 | 12/2014 |

OTHER PUBLICATIONS

Boiler Operation and Maintenance, Yu Jiehuo and Han Shufen, editors-in-chief, Beijing Institute of Technology Press, ISBN 978-7-5640-8913-9, May 2014, 105-109.

* cited by examiner

BURNER, BURNER MODULE, BURNER ASSEMBLY AND HEATING DEVICE COMPRISING SAME

CROSS REFERENCE TO RELATED APPLICATIONS

This application claims the benefit of priority under 35 U.S.C. § 119 (a) and (b) to Chinese Patent Application No. 202111680255.3, filed Dec. 30, 2021, the entire contents of which are incorporated herein by reference.

TECHNICAL FIELD

The present invention relates to a burner, a burner assembly comprising the burner, a burner module comprising the burner, and a heating device provided with the burner.

BACKGROUND $CO_2$ emission has become a common concern in the international community. This is one of the most important topics in the society today. People are making efforts to seek solutions for reducing $CO_2$ emission. One of the main directions is to reduce $CO_2$ emission by reducing energy consumption and increasing energy utilisation rate.

A burner is an apparatus that converts an oxidant and a fuel into heat by a chemical reaction of combustion. A heating device (for example, a furnace) heats a heated medium therein by the provision of a burner. The heating methods conventionally adopt flame radiation heating or indirect heating (with the heat of flame combustion transferred to the heated medium through a heat transfer medium), which has the characteristics of high thermal discharge, low thermal efficiency and high energy consumption. These problems are more serious for high-temperature manufacturing processes such as glass melting.

Generally, glass is made from a mixture of raw materials such as silicates, basalt, limestone, sodium carbonate, and other minor components, which are added to a glass furnace and melted into a liquid state at a temperature of approximately 1,250° C. to 1,500° C.; then the melt is formed. Depending on the intended use of the melt, for example, glass or fibres for various applications, a further melting and refining step is performed before the forming process. A conventional glass furnace comprises a burner that generates flame in the space between the surface of the glass melt and the top of the furnace, thereby heat is transferred to the glass melt by radiation from the flame itself and the top material. A lot of energy is consumed in the process of heat transfer.

In the prior art, submerged combustion is also used for glass melting and other industries, for example, processing of metals and solid waste (glass melting is used as an example below). Specifically, the submerged burner is located below the surface of the raw materials of glass. Submerged burners may be installed on the side wall and/or bottom of a glass furnace, and some may also be installed at the top of the furnace with the nozzles immersed in the glass melt. For submerged burners, the flame and the combustion products produced by the combustion of the fuel and the oxidant pass through the glass melt and directly contact the glass melt, and thus the heat transfer is much more effective than methods where the flame is located above the surface of the glass melt for radiation heat transfer, thus reducing the heat transfer to the refractory in the glass furnace and the heat loss in the flue gas, which can reduce fuel consumption and thus carbon dioxide emission. In addition, NOx emissions are also reduced during the combustion process due to the lower temperature above the glass melt in the combustion chamber. Further, the combustion products of a high flow rate generated by the oxidant and the fuel enter the glass melt, and the gas expands during the submerged combustion process, thereby the raw materials of glass melt rapidly and generate a large amount of turbulence. The molten glass is easier to be mixed evenly, which can eliminate the need for a mechanical stirrer in the prior art, and the heat transfer effect between a cold melt and a hot melt is better. Moreover, submerged burners have a smaller size, higher production efficiency and lower furnace installation costs than conventional burners that are provided above the glass melt.

However, for submerged burners, there are still various problems that need to be solved. For example, how to achieve more stable flame, prevent the flame from extinguishing, prevent burner backfire, reduce ablation of the burner, prevent explosion due to mixing of fluids, improve the combustion performance when hydrogen is used as the fuel, improve the heat transfer efficiency, prevent clogging of the nozzles by the heated medium, and monitor the status of the burner are issues requiring continuous attention during the design of submerged burners. These issues are also need attention and solutions in the design of non-submerged burners.

The purpose of the present invention is to overcome at least one aspect of the above problems and shortcomings and other technical problems in the prior art.

SUMMARY

In a first solution of the present invention, a burner is provided, and at least one first passage and at least one second passage are formed in the burner, wherein an inlet of each first passage is fluidly connected to a supply port of a first fluid, an inlet of each second passage is fluidly connected to a supply port of a second fluid, wherein the at least one first passage and the at least one second passage are arranged such that the first fluid from an outlet of the at least one first passage and the second fluid from an outlet of the at least one second passage are mixed with each other, wherein the at least one first passage is configured to cause the first fluid to produce a rotational flow in a first rotation direction, and/or, the at least one second passage is configured to cause the second fluid to produce a rotational flow in a second rotation direction.

In a second solution of the present invention, the burner according to the first solution is disclosed, the at least one first passage is configured to cause the first fluid to produce a rotational flow in a first rotation direction, the at least one second passage is configured to cause the second fluid to produce a rotational flow in a second rotation direction, and preferably, the first rotation direction is opposite to the second rotation.

In a third solution of the present invention, the burner according to the first or the second solutions is disclosed, wherein a helical groove with a helical direction being the first rotation direction is formed in at least a part of the at least one first passage.

In a fourth solution of the present invention, the burner according to any of the first to the third solutions is disclosed, wherein a helical groove with a helical direction being the second rotation direction is formed in at least a part of the at least one second passage.

In a fifth solution of the present invention, the burner according to any of the first to the fourth solutions is disclosed, wherein a mixing channel is formed in the burner, and the outlet of each of the first passages and the outlet of each of the second passages are fluidly connected to the mixing channel, so that the first fluid and the second fluid mix in the mixing channel and flow out through an outlet of the mixing channel.

In a sixth solution of the present invention, the burner according to the fifth solution is disclosed, the at least one first passage is a plurality of first passages, and the plurality of first passages are positioned such that the first fluid from the outlet of each of the first passages respectively merges into the mixing channel in the tangential direction of the mixing channel along the first rotation direction.

In a seventh solution of the present invention, the burner according to the sixth solution is disclosed, the second passage is one second passage, which is aligned with the mixing channel upstream of the mixing channel, and a helical groove with the helical direction being the second rotation direction that is opposite to the first rotation direction is formed in at least a part of the second passage.

In an eighth solution of the present invention, the burner according to the sixth solution is disclosed, a plurality of second passages are formed, and the plurality of second passages are positioned such that the second fluid from the outlet of each of the second passages respectively merges into the mixing channel in the tangential direction of the mixing channel along the second rotation direction, and the second rotation direction is opposite to the first rotation direction.

In a ninth solution of the present invention, the burner according to any of the sixth to the eighth solutions is disclosed, and each of the first passages comprises:

- a first part, which extends parallel to an axis of the burner from the inlet of the first passage; and
- a second part, extending obliquely toward the corresponding tangential direction of the mixing channel from the first part to the outlet of the first passage.

In a tenth solution of the present invention, the burner according to any of the sixth to the eighth solutions is disclosed, wherein each of the first passages extends obliquely toward the corresponding tangential direction of the mixing channel from its inlet to the outlet of the first passage.

In an eleventh solution of the present invention, the burner according to the third or the fourth solution is disclosed, wherein each of the first passages comprises:

- a first part, which extends parallel to an axis of the burner from the inlet of the first passage; and
- a second part, extending obliquely toward an axis of the burner from the first part to the outlet of the first passage; wherein an extension of an axis of the first part intersects the axis of the burner.

In a twelfth solution of the present invention, the burner according to the third or the fourth solution is disclosed, wherein each of the first passages extends obliquely toward an axis of the burner from its inlet to the outlet of the first passage, wherein an extension of an axis of the first passage intersects the axis of the burner.

In a thirteenth solution of the present invention, the burner according to the fifth to the twelfth solutions is disclosed, wherein the at least one first passage is a plurality of first passages, and the outlets of the plurality of first passages merge into the mixing channel at different positions in the direction of the axis of the burner.

In a fourteenth solution of the present invention, the burner according to the thirteenth solution is disclosed, wherein the outlets of the plurality of first passages arranged in sequence in the same clockwise direction as the first rotation direction merge into the mixing channel in sequence at positions closer to the outlet of the mixing channel.

In a fifteenth solution of the present invention, the burner according to the fifth to the fourteenth solutions is disclosed, and the sectional area of the outlet of the mixing channel is greater than the sectional area of the inner space of the mixing channel.

In a sixteenth solution of the present invention, the burner according to the fifth to the fourteenth solutions is disclosed, wherein the burner comprises a nozzle, wherein at least one through channel fluidly connected to the outlet of the mixing channel is formed in the nozzle.

In a seventeenth solution of the present invention, the burner according to the sixteenth solution is disclosed, wherein the through channel in the nozzle is a single through channel, and the sectional area of the outlet of the through channel is greater than that of the inner space of the mixing channel.

In an eighteenth solution of the present invention, the burner according to the sixteenth solution is disclosed, wherein a plurality of through channels are provided in the nozzle, and the sum of the sectional areas of the outlets of the plurality of through channels is greater than that of the inner space of the mixing channel.

In a nineteenth solution of the present invention, the burner according to the eighteenth solution is disclosed, wherein each of the through channels comprises a first part extending from its inlet in a direction away from an axis of the nozzle and a second part extending from the first part in a direction parallel to the axis of the nozzle to the outlet of the through channel.

In a twentieth solution of the present invention, the burner according to the eighteenth solution is disclosed, and each of the through channels extends from its inlet to its outlet in a direction gradually away from the axis of the nozzle.

In a twenty-first solution of the present invention, the burner according to any of the eighteenth to the twentieth solutions is disclosed, and a plurality of the through channels include inner channels and outer channels, wherein an outer outlet of each outer channel is located outside an inner outlet of each inner channel in the radial direction of the nozzle; preferably, the inner outlet has a smaller aperture than the outer outlet.

In a twenty-second solution of the present invention, the burner according to the twenty-first solution is disclosed, and the outer outlets are evenly distributed on one circumference, and/or the inner outlets are evenly distributed on one circumference.

In a twenty-third solution of the present invention, the burner according to the twenty-second solution is disclosed, the inner outlets are spaced apart from the outer outlets in the circumferential direction; preferably, each inner outlet is located in the middle between two outer outlets adjacent to it in the circumferential direction.

In a twenty-fourth solution of the present invention, the burner according to the first to the twenty-third solutions is disclosed, which comprises:

- a first fluid guide, wherein the at least one first passage is formed in the first fluid guide; and
- a second fluid guide, wherein the at least one second passage is formed in the second fluid guide;
- wherein the mixing channel is provided in the first fluid guide or the second fluid guide.

In a twenty-fifth solution of the present invention, the burner according to the twenty-fourth solution is disclosed, the mixing channel is formed in the first fluid guide, and an outlet end of the second fluid guide is disposed in the first fluid guide, so that the outlets (33) of the plurality of second passages are all fluidly connected to the mixing channel.

In a twenty-sixth solution of the present invention, the burner according to any of the first to the fourth solutions is disclosed, which comprises:

a first fluid guide, wherein the at least one first passage is formed in the first fluid guide; and a second fluid guide, wherein the at least one second passage is formed in the second fluid guide; wherein an outlet end of the second fluid guide is movably disposed in the first fluid guide.

In a twenty-seventh solution of the present invention, the burner according to any of the twenty-fourth and the twenty-fifth solutions is disclosed, the burner further comprises an independent body, the nozzle is connected to the body, and the nozzle, the first fluid guide, and the second fluid guide are all separate components.

In a twenty-eighth solution of the present invention, the burner according to any of the sixteenth to the twenty-fifth solutions is disclosed, the nozzle and the body of the burner are formed as an integral piece, a first cooling medium channel is integrated in the integral piece, and preferably the first cooling medium channel extends to the through channel of the nozzle.

In a twenty-ninth solution of the present invention, the burner according to any of the eighteenth to the twenty-third solutions is disclosed, and the range of the equivalent diameter of the outlet of each of the through channels is 0.3 mm-10 mm, preferably 0.8 mm-6 mm, more preferably 1 mm-5 mm, and still more preferably 1.5 mm-4 mm.

In a thirtieth solution of the present invention, the burner according to any of the sixteenth to the twenty-ninth solutions is disclosed, and the through channel is designed such that at a flow rate of the fluid mixture at the outlet of the through channel is greater than the propagation speed of the flame produced by the combustion of the fluid mixture.

In a thirty-first solution of the present invention, the burner according to any of the fifth to the thirtieth solutions is disclosed, the mixing channel is designed such that a flow rate of the fluid mixture in the mixing channel is greater than the propagation speed of the flame produced by the combustion of the fluid mixture, and preferably the mixing channel is designed such that a flow rate of the fluid mixture in the mixing channel is more than 15 times the propagation speed of the flame produced by the combustion of the fluid mixture.

In a thirty-second solution of the present invention, the burner according to the thirty-first solution is disclosed, the first passage and the second passage are designed such that a flow rate of the first fluid in the first passage and a flow rate of the second fluid in the second passage are both greater than the flow rate of the fluid mixture in the mixing channel, and preferably the flow rate of the second fluid in the second passage is greater than the flow rate of the first fluid in the first passage.

In a thirty-third solution of the present invention, the burner according to any of the first to the thirty-second solutions is disclosed, which further comprises a monitoring system, wherein the monitoring system comprises a sensor for monitoring the state of combustion of the burner, the sensor comprises, for example, a monitor for monitoring the flame, such as an ultraviolet monitor; and/or a thermocouple for measuring the temperature of the burner.

In a thirty-fourth solution of the present invention, the burner according to any of the first to the thirty-third solutions is disclosed, and either the first fluid or the second fluid is an oxidant, and the other is a fuel, preferably hydrogen.

In a thirty-fifth solution of the present invention, the burner according to any of the first to the thirty-fourth solutions is disclosed, wherein the burner is a submerged burner.

In a thirty-sixth solution of the present invention, a burner assembly is disclosed, which comprises:

the burner according to any of the first to the thirty-fifth solutions; and a cooling jacket provided outside the burner, with a second cooling medium channel formed in the cooling jacket.

In a thirty-seventh solution of the present invention, a burner assembly according to the thirty-sixth solution is disclosed, the burner comprises a step portion on the outside thereof, and the cooling jacket comprises a radially inward protrusion, wherein the protrusion is fitted on the step portion; preferably, the burner further comprises a sealing gasket disposed between the protrusion and the step portion.

In a thirty-eighth solution of the present invention, a burner module is disclosed, which comprises:

the burner according to any of the first to the thirty-fifth solutions or a plurality of burner assemblies according to the thirty-sixth or the thirty-seventh solution; and a common cooling block, with a plurality of installation spaces defined therein, wherein each of the burners or burner assemblies is installed in a corresponding one of the installation spaces; preferably, the burner and the common cooling block are formed as an integral piece, and a cooling medium channel is defined in the integral piece.

In a thirty-ninth solution of the present invention, the burner module according to the thirty-eighth solution is disclosed, the common cooling block is composed of a first part and a second part that are independent of each other, the first part and the second part together define the installation spaces, and preferably a flow direction of a cooling medium in the first part is opposite to that of the cooling medium in the second part.

In a fortieth solution of the present invention, a burner module is disclosed, which comprises:

a plurality of burners according to any of the first to the thirty-fifth solutions;

a first fluid supply pipeline capable of supplying the first fluid to each burner; and a second fluid supply pipeline capable of supplying the second fluid to each burner.

In a forty-first solution of the present invention, a burner module is disclosed, which comprises:

a plurality of burners according to the thirty-sixth or the thirty-seventh solution;

a first fluid supply pipeline capable of supplying the first fluid to each burner assembly; a second fluid supply pipeline capable of supplying the second fluid to each burner assembly; and a cooling medium loop capable of supplying a cooling medium to each burner assembly.

In a forty-second solution of the present invention, a heating device is disclosed, a heated medium is accommodated in the heating device, and the burner according to any of the first to the thirty-fifth solutions, or the burner assembly according to the thirty-sixth or the thirty-seventh solution, or the burner module according to any of the thirty-eighth to the forty-first solutions is provided in the heating device.

The present invention has at least the following benefits:

Since the flame and the combustion products are in direct contact with the heated medium, the heat transfer time is long and heat exchange is sufficient, which improves energy utilisation efficiency and reduces the emission of carbon dioxide and nitrogen oxides.

Since the burner is provided with a mixing channel for pre-mixing the fuel and the oxidant, the fuel and the oxidant are pre-mixed before being ejected from the burner, and therefore a stable and controllable flame can be obtained.

By forming a mixing channel inside the nozzle, more particularly in the first or the second fluid guide, the amount of the mixed fluid in the mixing channel is limited by the size of the first or the second fluid guide, and the limited mixing space prevents the accumulation of excess mixed gas and lowers the risk of explosion.

The burner of the present invention has higher flame stability, higher heat transfer efficiency and lower risk of explosion, especially when hydrogen is used as the fuel.

By using fluid guides to cause the fuel and/or the oxidant to produce a rotational flow for mixing, the mixing of the two can be made faster, more fully and uniformly, so as to achieve more stable combustion flame and combustion performance. By forming rotational flows of the first fluid and the second fluid in opposite rotation directions, the two fluids collide to achieve a strong mixing effect. A better mixing result can be achieved by a structure of cascade mixing.

The design of the outlet of the through channel larger than the mixing channel in area further prevents the flame from "burning back" into the burner, thereby preventing burner ablation or explosion. By providing a plurality of through channels in the nozzle, the area of the flame is increased in general. Since the aperture of the outlet of each through channel is small, the flame is shorter and thus more stable and not easy to extinguish, and the setting of the outlet aperture prevents the through channels of the nozzle from being blocked. Further, the design of the inner outlet with a small aperture makes the flame less easy to extinguish, and makes it easy to retain the combustion source in the burner and easier to reignite after flaming out.

The provided burner module and burner combinations allow the flexibility to meet the requirements of a variety of power ranges, and can reduce costs, create more compact structures to save space, and provide even cooling.

The maintenance of the burner is more convenient and less expensive thanks to the monitoring system and burner components independent of each other. In addition, the sectional area of each part of the burner matches the flow rate of each part, so that the burner is not easy to flame out, premature combustion inside the burner can be prevented, burner ablation can be prevented, and the life of the burner can be prolonged.

BRIEF DESCRIPTION OF THE FIGURES

The features and advantages of examples or embodiments of the present invention will be better understood with reference to the following description and accompanying drawings, wherein.

DETAILED DESCRIPTION OF THE PREFERRED EMBODIMENTS

Figure 1:
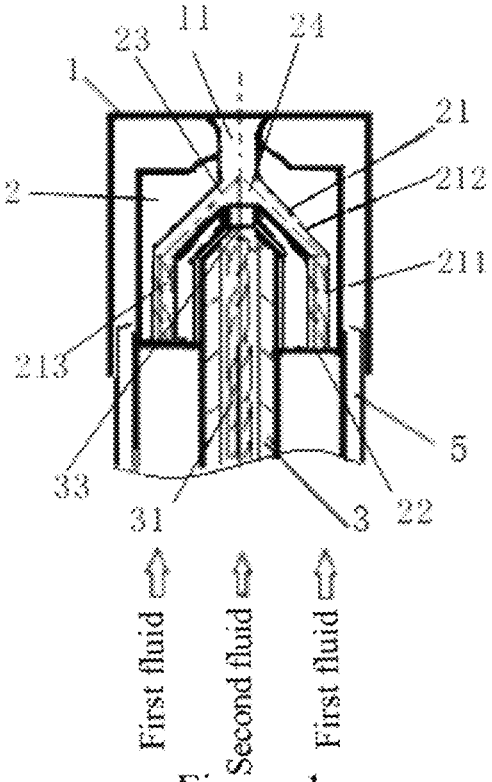
FIG. 1 is a schematic detail view of the end of the burner according to a first exemplary embodiment of the present invention.

The technical solutions of the present invention will be further described in detail below through the embodiments and in conjunction with the accompanying drawings. The following description of the embodiments of the present invention with reference to the drawings is intended to explain the general concept of the present invention, and should not be understood as a limitation on the present invention.

In addition, in the following detailed description, for convenience of explanation, numerous specific details are set forth in order to provide a thorough understanding of the embodiments. Obviously, however, one or more embodiments may be implemented without these specific details. In other cases, commonly-known structures and devices are not shown as graphical representations to simplify the drawings.

In the description of the specific embodiments below, it should be understood that terms such as "length", "width", "upper", "lower", "front", "back", "left", "right", "vertical", "horizontal", "top", "bottom", "inside", "outside", etc. indicate the orientations or positional relationships based on the orientations or positional relationships shown in the drawings, and are only for the convenience of describing the present invention and simplifying the description, rather than indicating or implying that the relevant devices or elements must have a specific orientation or be constructed and operated in a specific orientation, and therefore should not be understood as limiting the present invention.

In addition, the terms "first" and "second" are merely used for descriptive purposes, and must not be interpreted as indicating or implying relative importance or implicitly specifying the quantity of the technical feature indicated. Thus, features for which "first" and "second" are defined may explicitly or implicitly include one or more of said feature. In the description of the present invention, the meaning of "multiple" is two or more, unless clearly and specifically specified otherwise.

In the present invention, unless otherwise clearly specified and defined, terms such as "installed", "connected together", "connected" and "fixed" should be understood in a broad sense, e.g. may mean connected in a fixed manner, but may also mean removably connected, or forming a single piece; may mean mechanically connected, but may also mean electrically connected; may mean directly connected together, but may also mean connected indirectly via an intermediate medium; and may mean internal communication between two elements, or an interactive relationship between two elements. Those skilled in the art can understand the specific meaning of the above terms in the present invention according to the specific circumstances.

As used herein, the term "fuel" refers to a gaseous fuel, a liquid fuel or a solid fuel that can be used interchangeably or in combination with each other. If it is at least partially in the gaseous form, it can be introduced directly into the burner. If it is in the liquid or the solid form, it is introduced at the vicinity of the burner. Gaseous fuels may be natural gas (mainly methane), propane, hydrogen, syngas, biomass gas or any other hydrocarbon and/or compound containing sulphur and/or nitrogen. The solid or liquid fuel may mainly be any compound in a carbon-containing and/or hydrocarbon and/or sulfur-containing form. Those skilled in the art can decide the way in which the gaseous, liquid or solid fuel is introduced as required; it is not the intention of the present invention to impose any limitations in this regard.

As used herein, the term "nozzle" refers to a component positioned at an end of the burner that ejects fuel and oxidant and causes them to burn, which may be a separate component or a component that form an integral piece with another component.

As used herein, the terms "fusion", "melting", "melting operation", and "melting process" include an operation of heating a heated medium from an essentially solid state to an essentially liquid state.

As used herein, the term "melt" refers to a substance obtained after melting inorganic components, metals, organic compositions, etc., which may be molten glass, molten metal, molten resin, molten waste, etc.

As used herein, the term "glass melt" refers to a composition for making glass products, which may exist in any state between an essentially solid state and an essentially liquid state, including the essentially solid state and the essentially liquid state, with such a state between the raw materials and molten glass (including the raw materials and molten glass), including any level of partial melting intermediary of the raw materials and molten glass.

As used herein, the term "equivalent diameter" refers to the diameter of a circle that is equal to the sectional area of a profile.

As used herein, the term "axial" refers to a direction of an axis of rotation, an axis of symmetry, or an approximate centreline that is essentially parallel to the direction of the central axis of the burner. The term "radial" may refer to a direction or relationship relative to a line extending perpendicularly outward from a shared centreline, axis, or similar reference. For example, two concentric and axially overlapping cylindrical parts may be considered to be "radially" aligned in the axially overlapping portions of these parts, but not "radially" aligned in the portions of these parts not axially overlapping. In some cases, these parts may be considered to be "radially" aligned even though one or both of them may not be cylindrical (or otherwise radially symmetric).

As used herein, "flow rate" means the volume of "the first fluid, "the second fluid", "the mixed fluid", or the fluid mixture" referred to herein flowing through a unit cross section in the passage/channel or at an outlet per unit time, which may be expressed as the flow rate $v=V/(T*S)$, where V represents the volume of the fluid, T represents time, and S represents the sectional area of the passage/channel or at the outlet, in the unit of m/s for example.

Those skilled in the art can understand that, as described herein, the fluid from the outlet of a fluid passage merges into the mixing channel in the tangential direction of the mixing channel, wherein the "tangential direction" does not mean the exact tangent, but that the outlet of a passage intersects the outer contour of the mixing channel at a position near a tangent point in an approximately tangential direction so that the fluid can merge into the mixing channel from the outlet in an approximately tangential direction. The "tangent direction" also does not necessarily mean that the contour of the mixing channel is cylindrical or has a circular cross section. For the cross-sectional contour of an irregular curve, the tangent direction is a tangent direction on the curve.

In the following description, raw materials for glass are used as an example of the heated medium. However, those skilled in the art can understand that the heated medium may also be any other medium that needs to be heated, for example, solid waste or other solid substances, etc.

Figure 2:
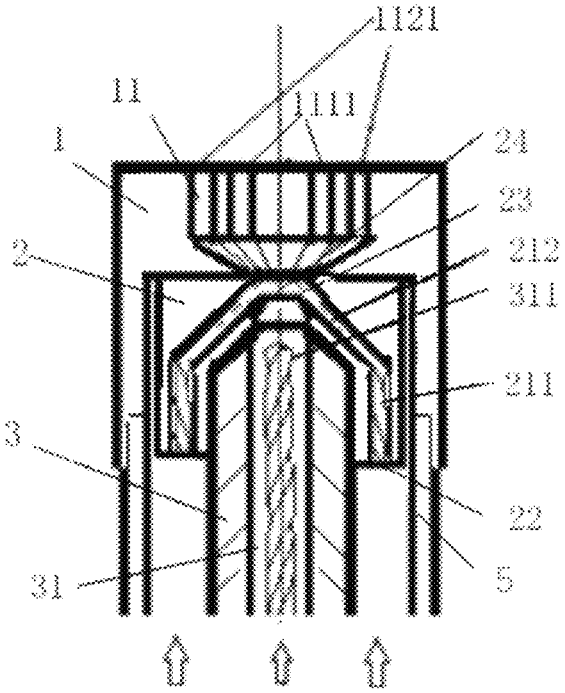
FIG. 2 is a schematic detail view of the end of the burner according to a second exemplary embodiment of the present invention.
Figure 3:
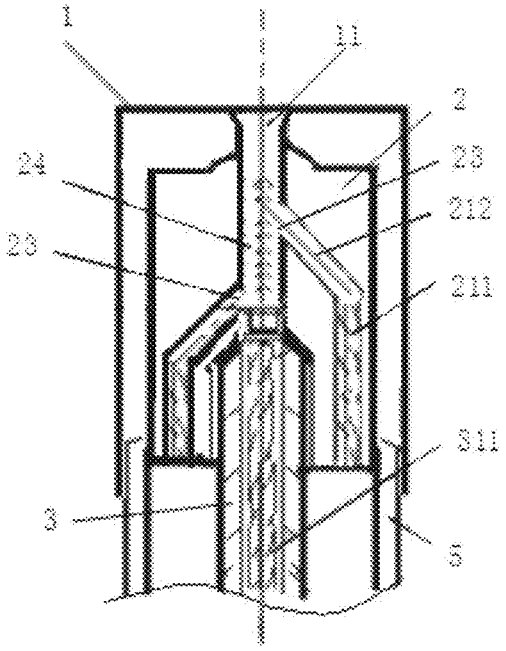
FIG. 3 is a schematic detail view of the end of the burner according to a third exemplary embodiment of the present invention.

According to an exemplary embodiment of the present invention, a burner is provided. Although the overall structure of the burner is not shown in the drawings for simplicity, those skilled in the art can understand the complete main structure of the burner, and FIGS. 1 to 3 show the end of the burner. At least one first passage 21 and at least one second passage 31 are formed in the burner, wherein an inlet 22 of each first passage is fluidly connected to a supply port of a first fluid; and an inlet of each second passage 31 is fluidly connected to a supply port of a second fluid; wherein the at least one first passage 21 and the at least one second passage 31 are arranged such that the first fluid from an outlet 23 of the at least one first passage 21 and the second fluid from an outlet 33 of the at least one second passage 31 are mixed with each other; wherein the at least one first passage 21 is configured to cause the first fluid to produce a rotational flow in a first rotation direction, and/or, the at least one second passage 31 is configured to cause the second fluid to produce a rotational flow in a second rotation direction.

In the above example, one of the first fluid and the second fluid is an oxidant, and the other is a fuel. In the following description, the first fluid is an oxidant and the second fluid is a fuel for illustration. However, those skilled in the art can also understand that the first fluid may also be the fuel and the second fluid may be the oxidant.

In the example of the present invention described above, the first fluid and/or the second fluid is formed into a rotational flow by the at least one first passage 21 and/or the at least one second passage 31, respectively, so that the mixing of the fuel and the oxidant is faster and the mixing result is better. In this example, at least one first passage 21 may be used to cause the oxidant to produce a rotational flow in the first rotation direction, or at least one second passage 31 may be used to cause the fuel to produce a rotational flow in the second rotation direction, or the methods for producing a rotational flow of the oxidant and a rotational flow of the fuel may be combined (in which case, preferably the first rotation direction is opposite to the second rotation direction), which can all improve the premixing level of the fuel and the oxidant, thereby ensuring the stability of the combustion flame.

In the embodiments shown in FIGS. 1 to 3, a mixing channel 24 formed in the burner is shown, and the outlet 23 of each of the first passages and the outlet 33 of each of the second passages 31 are fluidly connected to the mixing channel 24, so that the first fluid and the second fluid mix in the mixing channel 24 and flow out through the outlet of the mixing channel 24.

The level of mixing of the fuel and the oxidant plays a crucial role in the speed of combustion and the stability of the flame. In the present invention, by forming a mixing channel 24 in the burner, the fuel and the oxidant are premixed in the mixing channel 24 before being ejected from the burner. Premixing of the fuel and the oxidant results in a more stable combustion flame and faster combustion.

As a further example, as shown in FIGS. 1 to 3, the burner may comprise a first fluid guide 2, a second fluid guide 3 and a nozzle 1, wherein at least one first passage 21 is formed in the first fluid guide 2, at least one second passage 31 is formed in the second fluid guide 3, and the mixing channel 24 is formed in the first fluid guide. In an exemplary manner, the outlet end of the second fluid guide 3 is disposed in the first fluid guide 2, so that the second fluid from the second passage merges into the mixing channel 24. Although the mixing channel 24 is shown to be disposed in the first fluid guide in the figures, it should be understood that the mixing channel 24 may also be disposed in the second fluid guide. A burner with premixing has the risk of explosion caused by the premixed fluid. In the above example of the present invention, by forming a mixing channel 24 in the first fluid guide 2 or the second fluid guide 3, the volume of the mixing channel is limited by the size of the first or the second fluid guide, and the limited mixing space of the mixing channel prevents the accumulation of excess mixed gas and lowers the risk of explosion.

Figure 3A:
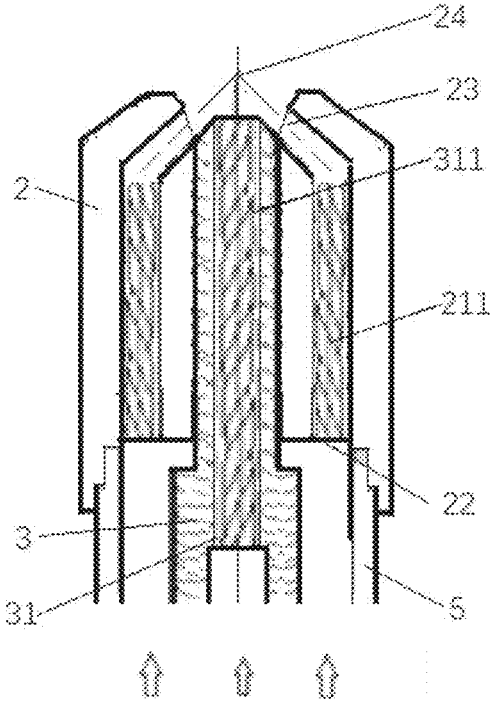
FIG. 3A is a schematic detail view of the end of the burner according to a fourth exemplary embodiment of the present invention.
Figure 3B:
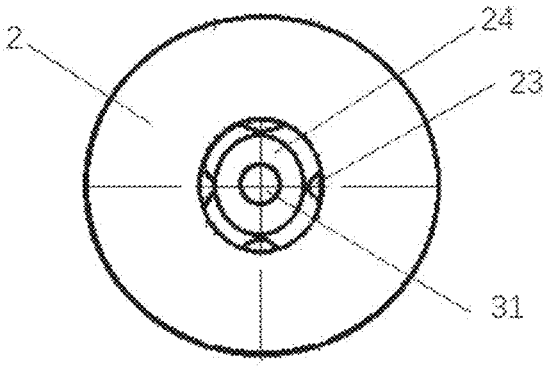
FIG. 3B is a schematic top view of the burner in FIG. 3A.

In the burner of the fourth embodiment shown in FIGS. 3A and 3B, the first fluid from the outlet 23 of the at least one first passage 21 and the second fluid from the outlet 33 of the at least one second passage 31 are mixed with each other. Further, the outlet end of the second fluid guide 3 is movably disposed in the first fluid guide 2, to adjust the mixing position of the first fluid and the second fluid, With this structure, as shown in FIGS. 3A and 3B, the position of the second fluid guide 3 can be adjusted up and down within a certain range, and thus the depth of the second passage 31 in the first fluid guide 2 can be adjusted, thereby changing the mixing position of the fuel and the oxidant, thus controlling the mixing effect of the fuel and the oxidant to adapt to different fuels/oxidants and other specific application scenarios.

In addition, those skilled in the art can understand that, although all the embodiments in FIGS. 1 to 3 show the technical solutions in which the burner comprises a nozzle 1, those skilled in the art can understand that the nozzle 1 may also be eliminated (an example of a structure in which the nozzle is eliminated is shown in FIGS. 3A and 3B, and it is also possible to conceive the structure of the burner in FIGS. 1 to 3 with the nozzle 1 outside it eliminated), the first fluid guide 2 may be part of the housing of the burner or the nozzle, and the mixture of the fuel and the oxidant is ejected from the mixing channel 24 for combustion. In this case, preferably, the flow rate of the fluid mixture at the outlet of the mixing channel 24 is greater than the propagation speed of the flame produced by the combustion of the fluid mixture. This prevents the explosion or ablation of the burner that could result from "burning back" of the flame from the outlet of the burner into the burner (also known as "backfire"). Preferably, the sectional area of the outlet of the mixing channel 24 may be greater than the sectional area of the inner space of the mixing channel. For example, the mixing channel may have a flared opening or a stepped opening. Since the sectional area of the outlet can be greater than that of the inner space of the mixing channel, the flow rate of the fluid mixture in the inner space of the mixing channel is greater than that of the fluid mixture at the outlet, which is more conducive for preventing backfire of the flame, i.e., preventing the flame from "burning back" into the burner, thus avoiding burner ablation or explosion. In order to further prevent backfire, a safety factor may be used. For example, the mixing channel may be designed such that the flow rate of the fluid mixture in the mixing channel is more than 15 times the propagation speed of the flame produced by the combustion of the fluid mixture. Those skilled in the art can also set the safety factor as needed.

Preferably, for the mixed gas to flow out quickly, preventing excess mixed fluid from accumulating in the mixing space to avoid explosion, achieving better mixing effect, and preventing backfire, the first passage, the second passage and the mixing channel of the burner are designed such that the flow rate of the first fluid in the first passage 21 and the flow rate of the second fluid in the second passage 31 are both greater than the flow rate of the fluid mixture in the mixing channel. As shown in the examples of FIGS. 1 to 3, the outlet 33 of the second passage 31 for conveying the second fluid is located upstream of the mixing channel 24 and the outlet 23 of the first passage 21. The flow rate of the second fluid at the outlet of the second passage 31 is greater than that of the first fluid at the outlet of the first passage 21, thereby the mixed fluid can flow out quickly. The mixing result will be better when the first fluid and the second fluid are ejected at higher speeds at the outlets of the first passage 21 and the second passage 31. In an exemplary manner, the flow rate of the oxidant may be in the range of, for example, 3 m/s to 250 m/s; in an exemplary manner, the flow rate of the fluid in the first passage 21 on the outside shown in FIG. 3A may be higher than 250 m/s, which will cool the upper surface of the first fluid guide 2 in the figure.

In the examples of the present invention, the fuel may be hydrogen. Hydrogen has many advantages as a clean energy, but it has been found that the hydrogen flame is not bright when it is used as a fuel, the emissivity is low, and there is a problem of low heat transfer efficiency in heating. In a submerged burner, thanks to the characteristics of direct contact heat conduction and convection in submerged combustion, the heat of the hydrogen flame can be fully transferred in the heated medium, and thus the heat of the hydrogen combustion can be better utilised. The use of hydrogen as the fuel for submerged burners also has the following advantages; as water is the only product of its oxidative combustion, carbon dioxide emission is reduced during the combustion process; in addition, glass melt, for example, needs to be clarified to eliminate bubbles therein, when hydrogen is used as the fuel, the partial pressure of the gaseous water produced is different from that of other gases present in the glass, and therefore the bubbles of these gases are more easily absorbed and merged into larger bubbles and discharged, thus making melting easier. However, it has been found that one of the problems with using hydrogen in submerged burners is that the combustion reaction between hydrogen and an oxidant is fast, and therefore premixing with it is relatively difficult and the risk is explosion is high.

By contrast, in the burner of the present invention, since the fuel and the oxidant are mixed in the mixing channel 24, whose volume is limited by the size of the first fluid guide or the second fluid guide, and there is no excess mixed gas in the mixing space, thus lowering the risk of explosion easily caused by premixing hydrogen and the oxidant. Therefore, while overcoming the shortcomings of hydrogen as a fuel, it can not only achieve effective premixing to ensure a stable and continuous flame, but also prevent the risk of explosion. Moreover, in the examples of the present invention, the fluid mixture flows out quickly from an outlet with a large sectional area for combustion, and at the same time, the two are well mixed in a limited mixing space thanks to the use of the rotational flow for mixing. Therefore, the burner of the present invention has excellent combustion performance, higher flame stability, higher heat transfer efficiency and lower risk of explosion especially with hydrogen as the fuel.

Figure 5:
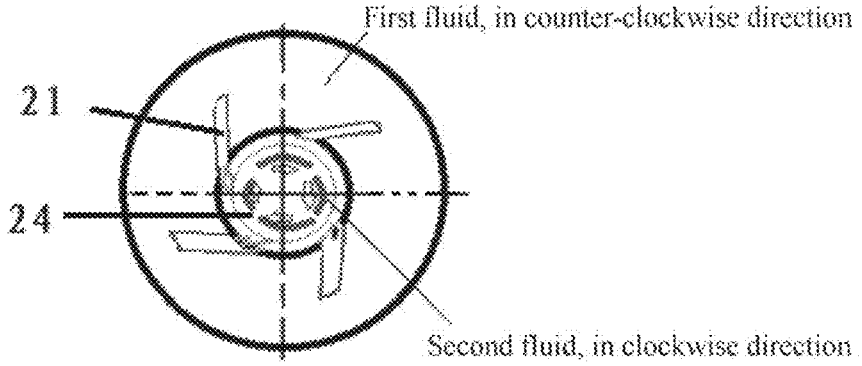
FIG. 5 is a schematic diagram of the direction of the first fluid and the second fluid producing rotational flows in two directions in the mixing channel.

Further, as mentioned above, a method for producing a rotational flow of both the fuel and the oxidant may be used, and preferably the first rotation direction of the oxidant is opposite to the second rotation direction of the fuel. In the present invention, an example is provided in which at least one first passage 21 is a plurality of first passages (four first passages shown in an exemplary manner in FIG. 5, but those skilled in the art will understand that more, for example, three, five, or six, first passages 21 may be provided), and these first passages are positioned in such a way that the first fluid from the outlet of each first passage respectively merges into the mixing channel 24 in the tangential direction of the mixing channel 24 along the first rotation direction (counter-clockwise in FIG. 5). In this example, the rotational flow of the first fluid is realized through the arrangement of the first passages 21 in the first fluid guide 2, thereby achieving sufficient mixing of the first fluid and the second fluid. As shown in FIG. 5, a plurality of first passages 21 are arranged to inject the first fluid, for example, an oxidant, into the mixing channel 24 as a whole in the counter-clockwise direction (as an example of the first rotation direction), while a second fluid, for example, a fuel, is rotated in the clockwise direction and injected into the mixing channel 24. The fuel rotating in the clockwise direction collides with the oxidant injected in the counter-clockwise direction, and the two are mixed violently, thus achieving a high level of mixing of the fuel and the oxidant.

In an exemplary manner, as shown in FIGS. 1 to 3, the second passage 31 may be provided as one, which is aligned with the mixing channel 24 upstream of the mixing channel 24, and a helical groove 311 with the helical direction being the second rotation direction that is opposite to the first rotation direction is formed in at least a part of the second passage. As shown in this example, the outlet end of the second fluid guide 3 is disposed in the first fluid guide 2, and the second passage 31 is aligned with the mixing channel 24, so that the second fluid is directly conveyed into the mixing channel 24 in the form of a rotational flow.

Those skilled in the art can understand that, although one second passage 31 is provided for forming a rotational flow of the second fluid in both the above example and the accompanying drawings, other methods may also be used, for example, providing a plurality of second passages, for example, in a way similar to the arrangement of the plurality of first passages, which are positioned such that the second fluid from the outlet of each second passage respectively merges into the mixing channel 24 in the tangential direction of the mixing channel 24 along the second rotation direction, which is opposite to the first rotation direction.

Those skilled in the art can understand that the various methods for forming a rotational flow described herein, for example, arranging a plurality of passages to merge into the mixing channel in the tangential direction of the mixing channel 24, and forming a helical groove in at least a part of the passages, can be used in combination to achieve more sufficient mixing.

In the embodiments of FIGS. 1 to 3, it is shown that each first passage 21 comprises a first part 211 and a second part 212, the first part 211 extends parallel to the axis of the first fluid guide 2 from the inlet 22 of the first passage 21; the second part 212 extends obliquely toward the corresponding tangential direction of the mixing channel 24 from the first part 211 to the outlet 23 of the first passage 21. Although it is not intuitively shown in the schematic diagrams of FIGS. 1 to 3 that the second parts 212 of the first passages 21 merge into the mixing channel 24 along the corresponding tangential directions of the mixing channel 24 at different positions (for example, at an interval of 90° in the circumferential direction), those skilled in the art can understand that the merging is similar to the method schematically shown in FIG. 5. With this structure, the first part 211 is provided to ensure the smooth inflow of the first fluid, and the second part 212 is provided for the overall rotation of the first fluid.

Those skilled in the art can also understand that the second part 212 may also be arranged to extend obliquely toward the axis of the first fluid guide 2 to the outlet 23 of the first passage 21, wherein the extension of the second part intersects the axis of the first fluid guide 2. To achieve a rotational flow of the first fluid, a helical groove 213 in the helical direction of the first rotation direction may be formed in the first part 211 and/or the second part 212.

As a variation, the first passage 21 may also be in other structures other than the first part and the second part in the above example. For example, each first passage 21 extends obliquely directly from its inlet 22 toward the corresponding tangential direction of the mixing channel 24 to the outlet 23 of the first passage 21; or each first passage 21 extends obliquely toward the axis of the first fluid guide 2 from its inlet 22 to the outlet 23 of the first passage 21, wherein the extension of the first passage intersects the axis of the burner, in which case, to form a rotational flow of the first fluid, a helical groove 213 with the helical direction being the first rotation direction may be formed in at least a part of the first passage 21.

In order to achieve more sufficient mixing of the fuel and the oxidant, as shown in FIG. 3, the at least one first passage 21 is a plurality of first passages, and the outlets 23 of the plurality of first passages 21 merge into the mixing channel at different positions (or different heights/levels) in the axial direction of the first fluid guide 2. In this example, four oxidant passages, for example, respectively merge into the mixing channel 24 at 0, 90, 180, and 270 degrees in the circumferential direction and at different horizontal planes.

In an exemplary manner, these first passages 21 merge into the mixing channel at the outlets 23 of the first passages 21 arranged in sequence in the same clockwise direction as the first rotation direction and in sequence at positions closer to the outlet of the mixing channel (positions on top of one another in sequence in FIG. 3). With this exemplary structure, the first fluid is rotated in the first rotation direction and at the same time mixed into the second fluid level by level, and thus the first fluid and the second fluid are mixed more sufficiently. In the above examples, the inlets of the plurality of first passages 21 may be evenly distributed on the same circumference.

As shown in FIGS. 1 to 3, the burner according to the present invention may also comprise a nozzle 1, and the first fluid guide 2 is at least partially arranged in the nozzle 1, wherein at least one through channel 11 fluidly connected to the outlet of the mixing channel is formed at the top of the nozzle 1. In the embodiments of FIGS. 1 and 3, a single through channel 11 is formed in the nozzle 1, and the sectional area of the outlet of the through channel 11 is greater than the sectional area of the inner space of the mixing channel. As described above, since the sectional area of the outlet of the through channel 11 is greater than that of the inner space of the mixing channel, the flow rate of the fluid mixture in the inner space of the mixing channel is greater than that of the fluid mixture at the outlet of the through channel 11, which is more conducive for preventing backfire of the flame into the burner.

As shown in FIG. 2, in an exemplary manner, a plurality of through channels 11 may be provided in the nozzle 1, and the sum of the sectional areas of the outlets of the plurality of through channels 11 is greater than that of the inner space of the mixing channel. By providing a plurality of through channels, the area of the flame is increased in general, and the equivalent diameter/aperture of the outlet of each through channel may be designed to be relatively small, thereby making the flame shorter and thus more stable and not easy to extinguish.

Figure 4:
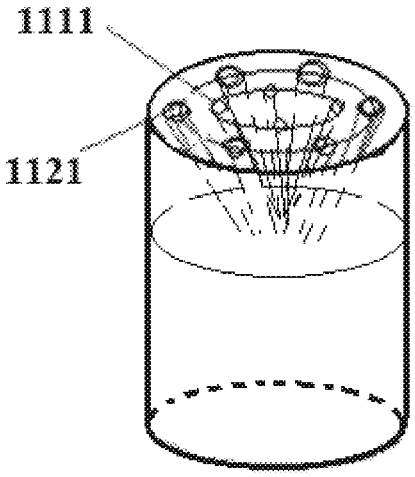
FIG. 4 is a schematic space view of an exemplary nozzle, wherein the dotted line shows a through channel in the nozzle.

For a plurality of through channels 11, in an exemplary manner, as shown in FIG. 2, each through channel 11 may comprise a first part extending from its inlet in a direction away from the axis of the nozzle and a second part extending from the first part in a direction parallel to the axis of the nozzle to the outlet of the through channel. With this structure, the first part of the plurality of through channels extends from the mixing channel 24 to the second part parallel to the axial direction of the nozzle, thus increasing the area of the flame, reducing the aperture of the outlet of each through channel, and making the flame shorter and thus more stable and not easy to extinguish. In an exemplary manner, as shown in FIG. 4, each of the through channels 11 (including outer channels with the outer outlets 1121 and the inner channels with the inner outlets 1111) may also be arranged to extend gradually away from the axis of the nozzle from its inlet to its outlet. This structure can also increase the flame area and reduce the aperture of the outlet of each through channel, to make the flame shorter and thus more stable and not easy to extinguish.

Further, as shown in FIGS. 2 and 4, the plurality of through channels 11 may include inner channels and outer channels, wherein each outer outlet 1121 of the outer channels is located outside each inner outlet 1111 of the inner channels in the radial direction of the nozzle. In this structure, since the inner channels are closer to the inner fuel passages (i.e., the second passages 31), the fuel content is higher than that in the outer channels, so that the flame in the inner channels is less likely to extinguish, and ignition can be made faster after the flame extinguishes.

Preferably, as shown in FIG. 4, the aperture of the inner outlets 1111 of the through channels is smaller than that of the outer outlets 1121. For the inner outlet 1111 with a small aperture, the flame is shorter, and the fuel content is higher, so that it is not easy to extinguish, and it is convenient to retain the combustion source of the burner; in addition, the momentum and impact force of the fluid mixture flowing out are smaller, so that it is easier to reignite after the flame extinguishes. As shown in FIG. 4, the outer outlets 1121 may be evenly distributed on the same circumference. Thus, the flame intensity is made more uniform in general. The inner outlets 1111 may also be evenly distributed on the same circumference. Preferably, as shown in FIG. 4, the inner outlets 1111 are spaced apart from the outer outlets 1121 in the circumferential direction; more preferably, each inner outlet 1111 is located in the middle between two outer outlets 1121 adjacent to it in the circumferential direction. All of the above methods can achieve a more even distribution of the fluid mixture to form a more uniform flame intensity.

In the present invention, for the outlets of the plurality of through channels 11 of the nozzle 1, for example, the inner outlets 1111 and the outer outlets 1121, in order to prevent blocking of the through channels 11 caused by the infiltration of the glass melt into the through channels 11 from these outlets, the equivalent diameter of the outlets of the through channels is designed to be 0.3 mm-10 mm, preferably 0.8 mm-6 mm, more preferably 1 mm-5 mm, and still more preferably 1.5 mm-4 mm. The equivalent diameter is small enough to prevent the glass melt from infiltrating back into the through channels, while allowing the flow of the fluid mixture. In the burner of the present invention, the dimension of the outlets of the through channels described above, the setting of the flow rate of the first fluid and the second fluid and a high flow rate of the fluid mixture produced thereby, and the pressure of the mixed fluid in the mixing channels independently or in combination ensure that the outlets of the through channels are not easy to be blocked, thus preventing damages to the burner nozzle and the burner. The sectional area of each part of the burner matches the flow rate of each part, so that the burner is not easy to flame out, premature combustion inside the burner can be prevented, burner ablation can be prevented, and the life of the burner can be prolonged.

In an exemplary manner, the burner of the present invention further comprises an independent body 5, the nozzle 1 may be connected to the body 5, and the nozzle 1, the first fluid guide 2 and the second fluid guide 3 are all separate components. With this exemplary structure, individual replacement of the nozzle 1 the first fluid guide 2 and the second fluid guide 3 is made possible, thereby lowering the maintenance costs of the burner.

In an exemplary manner, the nozzle 1 and the body of the burner may be formed as an integral piece, a first cooling medium channel (not shown in the figures) may be integrated in the integral piece, and preferably the first cooling medium channel may extend to the through channel 11 of the nozzle 1. With this structure, since the cooling channel can extend into the nozzle, the burner, especially the nozzle, can be effectively cooled.

The structure and working process of the burner as the first, second, third and fourth exemplary embodiments of the present invention will be described in detail below with reference to FIGS. 1 to 3, 3A and 3B. Those skilled in the art can understand that these structures and the description are only used as examples, and should not be construed as a necessary limitation on any technical solution of the present invention.

In a first embodiment, the burner comprises a nozzle 1, a body 5, a first fluid guide 2 arranged at least partially on the inner wall of the nozzle 1, and a second fluid guide 3 with its outlet end arranged in the first fluid guide 2, and the body 5 may be a separate component connected to the nozzle 1. As shown in FIG. 1, a mixing channel 24 is formed in the first fluid guide 2, the outlet 33 of the second passage 31 of the second fluid in the second fluid guide 2 is aligned with the mixing channel 24, and thus the second fluid (which may be the fuel or the oxidant) ejected from the outlet 33 of the second passage 31 directly enters the mixing channel 24.

A helical groove is formed in the second passage 31, which causes the second fluid to produce a rotational flow rotating in the right-hand direction in the example shown in FIG. 1, and thus the second fluid enters the mixing channel 24 in right-handed rotation (corresponding to the clockwise direction in FIG. 5, which may be regarded as a schematic diagram of the direction of the rotational flow viewed from the bottom of FIG. 1). At the same time, the first passage 21 formed in the first fluid guide 2 comprises a first part 211 and a second part 212, wherein the first part 211 extends parallel to the axis of the first fluid guide 2 from the inlet 22 of the first passage 21; the second part 212 extends obliquely toward the corresponding tangential direction of the mixing channel 24 from the first part 211 to the outlet 23 of the first passage 21, wherein the schematic direction diagram of FIG. 5 may be referenced for the extension direction of the second part 212, wherein the second parts 211 of the four first passages 21 merge into the mixing channel 24 in sequence in the counter-clockwise direction, thereby forming a rotational flow of the first fluid in the left-hand direction (counter-clockwise direction) in the mixing channel 24. In addition, a helical groove 213 in the left-handed rotation direction is also formed in the first part 211 in FIG. 1, and the provision of the helical groove further improves the effect of forming a rotational flow of the first fluid. The first fluid and the second fluid collide in the mixing channel 24, as shown in FIG. 5, the opposite rotation directions make them more fully and effectively mixed, and the two are rapidly mixed, conveyed to the through channel 11 from the mixing channel 24, and ejected from its outlet for combustion. In the first embodiment, only one through channel 11 is provided, with a flared outlet as an example, its sectional area is greater than that of the mixing channel 24, and the flow rate of the fluid mixture in the mixing channel is greater than that of the fluid mixture at its outlet. In this way, the flame is further prevented from burning back to the mixing channel 24 and the inside of the burner.

FIG. 2 shows the burner according to a second exemplary embodiment of the present invention. In the second embodiment, a plurality of through channels 11 are formed in the nozzle 1, and the plurality of through channels 11 include inner channels and outer channels, wherein each outer outlet 1121 of the outer channels is located outside each inner outlet 1111 of the inner channels in the radial direction of the nozzle. The sum of the sectional areas of the outlets 1111 and 1121 of the plurality of through channel is greater than the sectional area of the mixing channel 24. It is shown in FIG. 2 that each through channel 11 comprises a first part extending from its inlet in a direction away from the axis of the nozzle and a second part extending from the first part in a direction parallel to the axis of the nozzle to the outlet of the through channel. With this structure, the first part of the plurality of through channels extends from the mixing channel 24 to the second part parallel to the axial direction of the nozzle, thus increasing the area of the flame, reducing the aperture of the outlets 1111 and 1121 of each through channel, and making the flame shorter and thus more stable and not easy to extinguish. Similar to the first embodiment, the first fluid and the second fluid are rapidly mixed at the mixing channel 24, or the mixing space, the mixture enters the first part of the through channel 11, passes the second part, and is ejected for combustion. Each outer outlet 1121 of the outer channels may also have an aperture larger than that of each inner outlet 1111 of the inner channels, as shown in FIG. 4. As described above, for the inner outlet 1111 with a small aperture, the fuel content is higher, and the flame is shorter, so that it is not easy to extinguish, and it is convenient to retain the combustion source of the burner; in addition, the momentum and impact force of the fluid mixture flowing out are smaller, so that it is easier to ignite after the flame extinguishes.

In the burner according to a third exemplary embodiment of the present invention shown in FIG. 3, for example, four first passages are formed in the first fluid guide 2, which are respectively positioned at 90 degrees in the circumferential direction, each second part 212 merges into the mixing channel 24 at a different height along the axis direction in sequence in the left-handed rotation direction, and the cascade merging makes the first fluid merge into the second fluid step by step, thus achieving more uniform mixing.

In the burner according to a fourth exemplary embodiment of the present invention shown in FIG. 4, a helical groove is formed in the first passage, and a helical groove 311 is also formed in the second passage. In this way, the first fluid from the outlet 23 of the first passage of the first fluid guide 2 forms a right-handed rotational flow, the second fluid from the outlet of the second passage of the second fluid guide 3 forms a left-handed rotational flow, and the two collide at position 24 to achieve a good mixing effect. As described above, the position of the second fluid guide 3 can be adjusted up and down, so that the mixing position and mixing effect can be adjusted.

Figure 6:
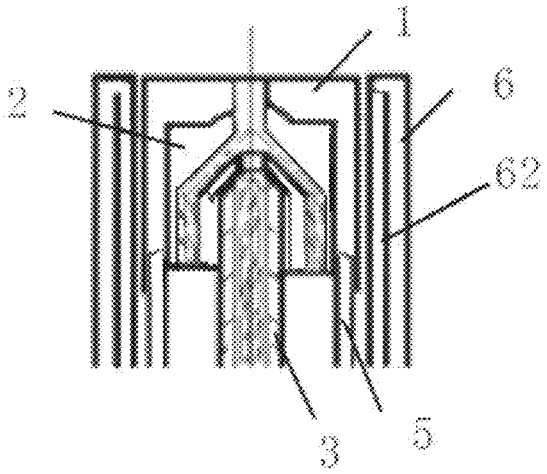
FIG. 6 is a schematic diagram of an exemplary burner assembly, which comprises the burner in the first exemplary embodiment.
Figure 7:
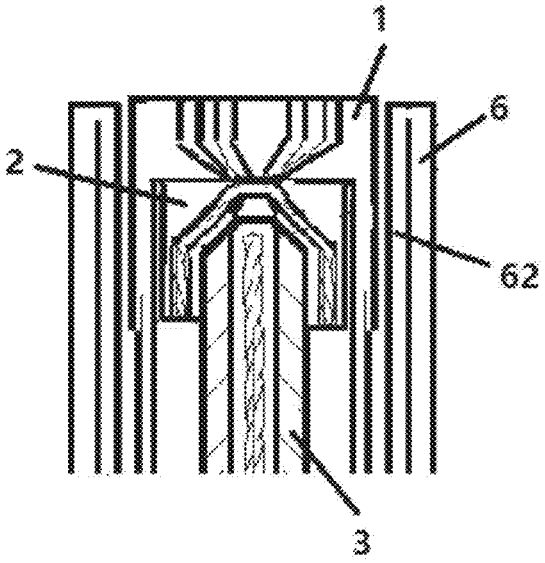
FIG. 7 is a schematic diagram of another burner assembly, which comprises the burner in the second exemplary embodiment.

Further, cooling is very important for burners, especially submerged burners, to prevent ablation and damage to burner components. As shown in FIGS. 6 and 7, the present invention also provides a burner assembly, which may comprise a burner of the various examples above and a cooling jacket 6 disposed outside the burner, wherein a second cooling medium channel 62 is formed in the cooling jacket. The cooling medium flows in the second cooling medium channel 62, to cool the burner to prevent the temperature of the burner from exceeding the maximum temperature it can withstand. In an exemplary manner, several openings (for example, 4 to 8 openings) may be made in the refractory bricks of the furnace, and a separate cooling jacket may be provided in each opening. Each burner may be inserted into one cooling jacket, forming a burner group as a whole. A burner group may be sized based on the heating position and the heating power needs. Preferably, the burner may also comprise a step portion on its outside, and accordingly, the cooling jacket comprises a radially inward protrusion, wherein the protrusion is fitted on the step portion. Preferably, the burner further comprises a sealing gasket disposed between the protrusion and the step portion, to prevent the melt from entering the gap between the cooling jacket and the burner.

Figure 8:
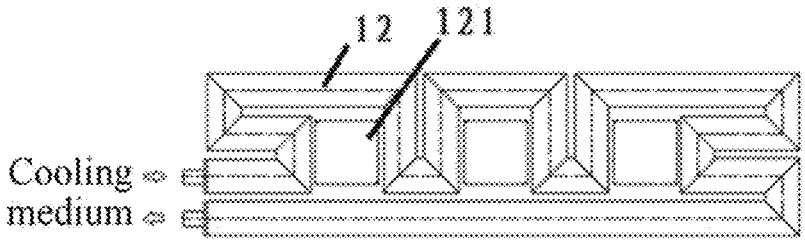
FIG. 8 is a schematic diagram of the burner module of an exemplary embodiment of the present invention.
Figure 8A:
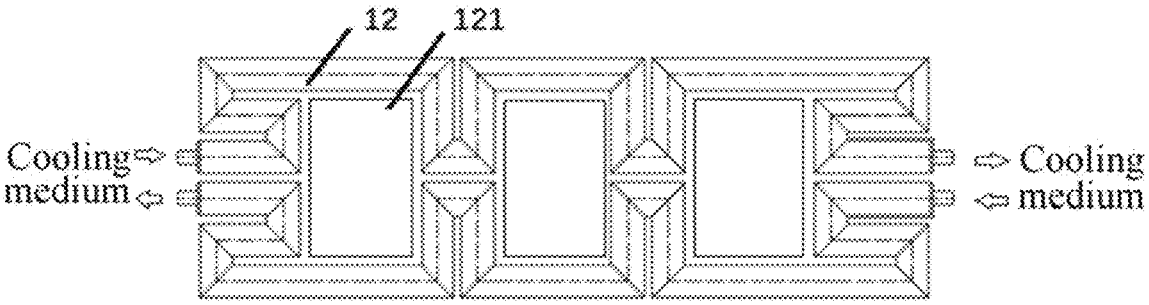
FIG. 8A is a schematic diagram of the burner module of another exemplary embodiment of the present invention.
Figure 9:
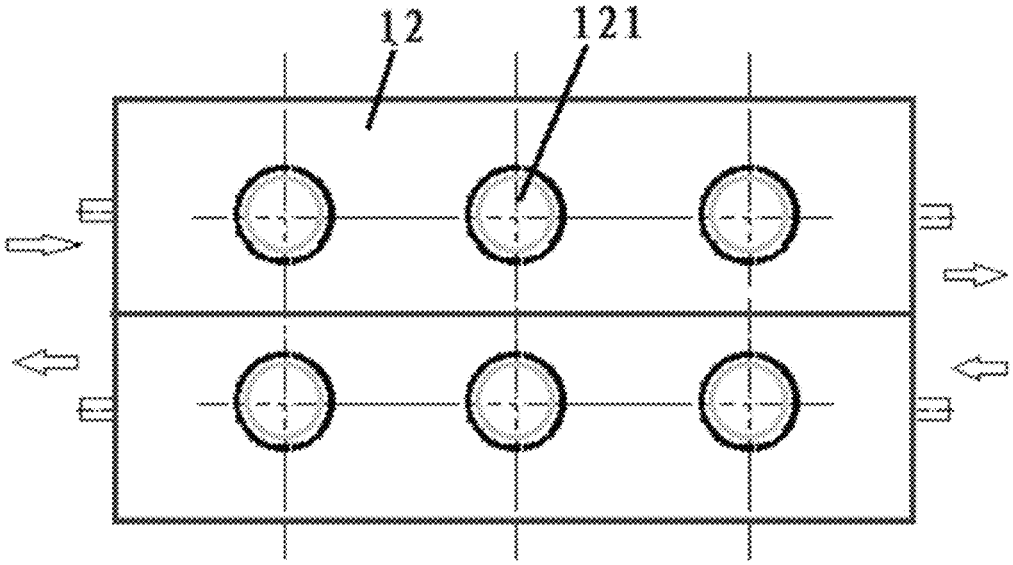
FIG. 9 is a schematic diagram of the burner module of yet another exemplary embodiment of the present invention.

In order to save costs and simplify the installation process, the present invention also provides a burner module, which comprises the burners in the above examples and a common cooling block 12, as shown in FIG. 8, 8A or 9. A plurality of installation spaces 121 are defined in the common cooling block 12 (for example, a cooling plate), wherein each burner is installed in each of the installation spaces and is cooled therein. In this approach, the costs are lowered and installation is simplifies by eliminating the need to install separate cooling jackets for each burner. Those skilled in the art can understand that, in order to achieve a better cooling effect, the burner assembly comprising the cooling jacket 6 may also be arranged in the installation spaces 121 for doubled cooling of the burner. In order to save space and costs and achieve a better cooling effect, the burner may also be combined with the common cooling block 12 to form one integral piece. For example, the outer surface of the burner (the outer surfaces of the nozzle 1 and the body 5, or the outer surface of the integral piece where the nozzle and body is an integral piece) and the common cooling block together define a cooling channel for the cooling medium. In other words, in this example, the burner is integrated with the common cooling block 12, resulting in space and cost savings and better cooling. As shown in FIG. 8A, the common cooling block 12 is composed of a first part and a second part that are independent of each other, and the first part and the second part together define the installation spaces 121. Preferably, the flow direction of the cooling medium in the first part is opposite to the flow direction of the cooling medium in the second part. The structure shown in FIG. 8A provides adequate cooling and facilitates placement of the burner or burner assembly. When the size of the burner is slightly different from that of the installation space, the relative position between the first part and the second part may be adjusted to adapt to its size for the best fitting.

Figure 10:
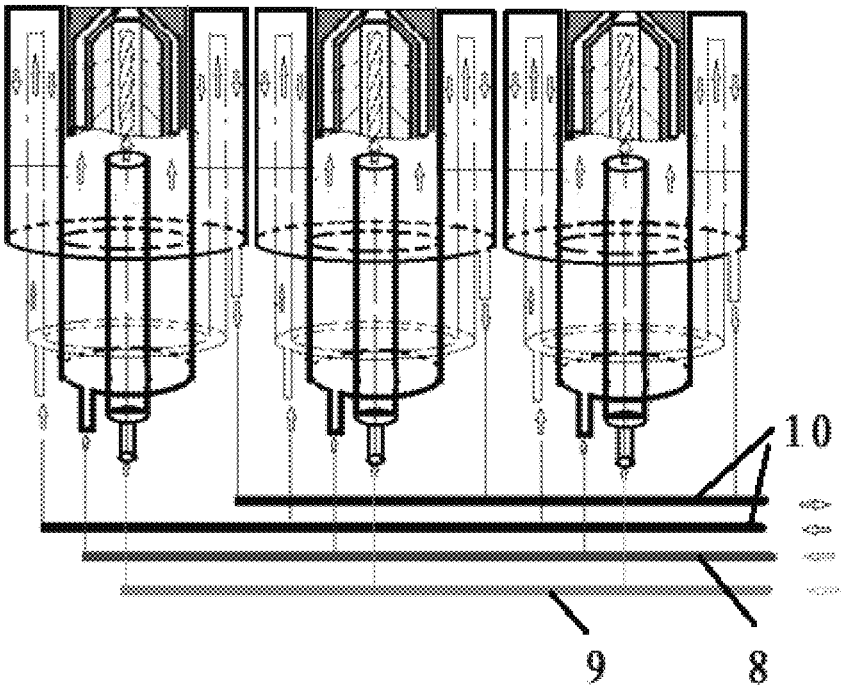
FIG. 10 is a schematic diagram of the burner combination of an exemplary embodiment of the present invention.

The present invention also provides another burner module, which comprises a plurality of burners of the above examples, a first fluid supply pipeline 8 supplying each burner with the first fluid, and a second fluid supply pipeline 9 capable of supplying each burner with the second fluid. As shown in FIG. 10, equipment costs can be lowered by using a plurality of burners together to form a burner combination or module and centrally supplying the first fluid and the second fluid to these burners (for example, 4 to 8 burners). In an exemplary manner, a supply control system for the first fluid/second fluid may be provided separately for each burner, which comprises, for example, a valve, and a display for separately displaying parameters such as the flow rate, temperature or pressure may also be provided on each burner, so that the supply to each burner can be adjusted as required. Those skilled in the art can understand that the above-mentioned burner assemblies provided with cooling jackets may also be supplied in a centralized manner, i.e., another burner module can be provided, which comprises a plurality of the burner assemblies described above, a first fluid supply pipeline 8 capable of supplying the first fluid to each burner assembly, a second fluid supply pipeline 9 capable of supplying the second fluid to each burner assembly, and a cooling medium loop 10 capable of supplying the cooling medium to each burner assembly.

The present invention also provides a heating device, which is, for example, a glass furnace, a heated medium is accommodated in the heating device, and one or more of the burner, burner assembly and burner module described above may be provided in the heating device. The burner, or burner assembly, or burner module may be positioned in the bottom or side wall or top wall of the furnace. The nozzle of a submerged burner is immersed in the heated medium. The heating device can achieve various power ranges as required by flexibly combining the burners.

It should be noted that, although a submerged burner is sometimes used for description in the above description, the structure of the burner of the present invention is not limited to a submerged burner, and burners adopting the structure of the present invention can all provide the benefits described above such as good mixing, stable and controllable flame, a large flame area, higher heat transfer efficiency, easier maintenance, etc.

Although some embodiments of the general concept of the present invention have been shown and described, those ordinarily skilled in the art will understand that changes can be made to these embodiments without departing from the principle and motivation of the general concept of the present invention. The scope of the present invention is defined by the claims and their equivalents.

What is claimed is:

1. A burner, comprising at least one first passage and at least one second passage formed within the burner, wherein an inlet of each of the at least one first passage is fluidly connected to a supply port of a first fluid, and an inlet of each of the at least one second passage is fluidly connected to a supply port of a second fluid;

wherein the at least one first passage and the at least one second passage are arranged such that the first fluid from an outlet of the at least one first passage and the second fluid from an outlet of the at least one second passage are mixed with each other;

wherein the at least one first passage is configured to cause the first fluid to produce a rotational flow in a first rotation direction; and/or the at least one second passage is configured to cause the second fluid to produce a rotational flow in a second rotation direction, wherein the burner is configured to operate as a submerged burner, wherein a mixing channel is formed in the burner, and the outlet of each of the first passages and the outlet of each of the second passages are fluidly connected to the mixing channel, so that the first fluid and the second fluid mix in the mixing channel and flow out through an outlet of the mixing channel, and wherein the at least one first passage is a plurality of first passages, and the plurality of first passages are positioned such that the first fluid from the outlet of each of the first passages respectively merges into the mixing channel in the tangential direction of the mixing channel along the first rotation direction.

2. The burner according to claim 1, wherein the second passage is one second passage, which is aligned with the mixing channel upstream of the mixing channel, and a helical groove with the helical direction being the second rotation direction that is opposite to the first rotation direction is formed in at least a part of the second passage.

3. The burner according to claim 1, wherein a plurality of second passages are formed, and the plurality of second passages are positioned such that the second fluid from the outlet of each of the second passages respectively merges into the mixing channel in the tangential direction of the mixing channel along the second rotation direction, and the second rotation direction is opposite to the first rotation direction.

4. The burner according to claim 1, wherein each of the first passages comprises:

a first part, which extends parallel to an axis of the burner from the inlet of the first passage; and a second part, extending obliquely toward the corresponding tangential direction of the mixing channel from the first part to the outlet of the first passage.

5. The burner according to claim 1, wherein each of the first passages extends obliquely toward the corresponding tangential direction of the mixing channel from the inlet to the outlet of the first passage.

6. A method of utilizing a burner comprising at least one first passage and at least one second passage formed within in the burner, wherein an inlet of each of the at least one first passage is fluidly connected to a supply port of a first fluid, and an inlet of each of the at least one second passage is fluidly connected to a supply port of a second fluid;

wherein the at least one first passage and the at least one second passage are arranged such that the first fluid from an outlet of the at least one first passage and the second fluid from an outlet of the at least one second passage are mixed with each other;

wherein the at least one first passage is configured to cause the first fluid to produce a rotational flow in a first rotation direction; and/or the at least one second passage is configured to cause the second fluid to produce a rotational flow in a second rotation direction, and wherein the burner is configured to operate as a submerged burner, the method comprising, introducing the first fluid from the supply port of the first fluid into the at least one first passage, introducing the second fluid from the supply port of the second fluid into the at least one second passage, mixing the first fluid and the second fluid, thereby producing a mixed fluid, wherein the first fluid rotates in a first rotational direction and the second fluid rotates in a second rotational direction, and wherein the burner operates as a submerged burner, wherein a mixing channel is formed in the burner, and the outlet of each of the first passages and the outlet of each of the second passages are fluidly connected to the mixing channel, so that the first fluid and the second fluid mix in the mixing channel and flow out through an outlet of the mixing channel, wherein the at least one first passage is a plurality of first passages, and the plurality of first passages are positioned such that the first fluid from the outlet of each of the first passages respectively merges into the mixing channel in the tangential direction of the mixing channel along the first rotation direction.

7. The method according to claim 6, wherein the second passage is one second passage, which is aligned with the mixing channel upstream of the mixing channel, and a helical groove with the helical direction being the second rotation direction that is opposite to the first rotation direction is formed in at least a part of the second passage.

8. The method according to claim 6, wherein a plurality of second passages are formed, and the plurality of second passages are positioned such that the second fluid from the outlet of each of the second passages respectively merges into the mixing channel in the tangential direction of the mixing channel along the second rotation direction, and the second rotation direction is opposite to the first rotation direction.

9. The method according to claim 6, wherein each of the first passages comprises:

a first part, which extends parallel to an axis of the burner from the inlet of the first passage; and a second part, extending obliquely toward the corresponding tangential direction of the mixing channel from the first part to the outlet of the first passage.

10. The method according to claim 6, wherein each of the first passages extends obliquely toward the corresponding tangential direction of the mixing channel from the inlet to the outlet of the first passage.

* * * * *